United States Patent [19]

Szostak

[11] 4,422,396

[45] Dec. 27, 1983

[54] BELT RETAINER GUARD FOR SEWING MACHINE

[75] Inventor: Jan Szostak, Lincroft, N.J.

[73] Assignee: The Singer Company, Stamford, Conn.

[21] Appl. No.: 398,025

[22] Filed: Jul. 14, 1982

[51] Int. Cl.[3] ..... D05B 83/00

[52] U.S. Cl. ..... 112/261; 474/144

[58] Field of Search ..... 112/261, 202, 220; 474/144, 145, 140, 111

[56] References Cited

U.S. PATENT DOCUMENTS

| | | | |
|---|---|---|---|
| 862,240 | 8/1907 | Diehl . | |
| 1,207,242 | 12/1916 | Turner . | |
| 1,296,259 | 3/1919 | Bliss | 474/144 X |
| 1,704,532 | 3/1929 | Curtis | 474/140 X |
| 2,074,045 | 3/1937 | Carpenter | 474/144 X |
| 2,607,241 | 8/1952 | Peterson . | |
| 2,788,760 | 4/1957 | Pierce . | |
| 3,420,200 | 1/1969 | Johnson | 112/220 X |
| 3,979,964 | 9/1976 | McCordall | 474/111 |
| 4,240,368 | 12/1980 | Adams | 112/200 |

FOREIGN PATENT DOCUMENTS 1931401 11/1965 Fed. Rep. of Germany .

*Primary Examiner*—Werner H. Schroeder
*Assistant Examiner*—Andrew M. Falik
*Attorney, Agent, or Firm*—William V. Ebs; Edward L. Bell; Robert E. Smith

[57] ABSTRACT

A sewing machine with a timing belt for transmitting power from a toothed driving pulley to a toothed driven pulley that rotates a loop taker is provided at each pulley on the belt entering side only with a belt guard which guides the belt onto the pulley and prevents teeth on the belt from jumping over teeth on the pulley.

3 Claims, 4 Drawing Figures

BELT RETAINER GUARD FOR SEWING MACHINE

DESCRIPTION

BACKGROUND OF THE INVENTION

1. Field of the Invention

The invention relates to the use of timing belts for transmitting power between driving and driven pulleys in a sewing machine.

2. Description of the Prior Art

It is well known to transmit power in a sewing machine to a rotatable loop taker through a belt connecting a driving pulley with a driven pulley which is affixed to the loop taker shaft. The belt and pulleys are generally provided with teeth to prevent slippage of the belt on the pulleys and a resulting disturbance of an established timing relationship between rotational movement of the loop taker and endwise reciprocation of a sewing needle. Nevertheless, it has been found that as the belt ages, and either stretches or becomes worn, teeth on the belt will sometimes jump over teeth on the pulleys.

It is a prime object of the present invention to prevent a belt from slipping on engaged pulleys in a sewing machine.

More particularly, it is an object of the present invention to preserve the timing relationship between movements of a belt driven loop taker, and a needle in a sewing machine.

It is another object of the invention to maintain teeth on a power transmitting timing belt in a sewing machine in positive engagement with the teeth of a driving and driven pulley which are operatively connected through the belt.

It is also an object of the invention to improve the performance of a belt drive in a sewing machine with only very simply constructed parts and with minimum cost.

Other objects and advantages of the invention will become apparent during a reading of the specification taken in connection with the accompanying drawings.

SUMMARY OF THE INVENTION

In accordance with the invention, a sewing machine having a belt drive is provided with a pair of judiciously placed abbreviated belt guards effective to prevent a timing belt from jumping over the teeth on a driving and a driven pulley which are engaged by the belt. One guard is located on the belt entering side only of the driving pulley and the other guard is located on the belt entering side only of the driven pulley. The guards, which are preferably adjustable toward and away from the outer surface of the belt, serve as guides assuring that teeth on the belt successively enter into engagement with successive teeth on the pulleys, and further serve as obstacles to outward movement of the belt from the pulleys such as could cause teeth on the belt to jump over teeth on the pulleys. Inwardly acting belt deflecting means is preferably provided for use in adjusting tension in the belt and further assuring continuous positive meshing engagement between teeth of the belt and of the pulley.

DESCRIPTION OF THE PREFERRED EMBODIMENT

Figure 1:
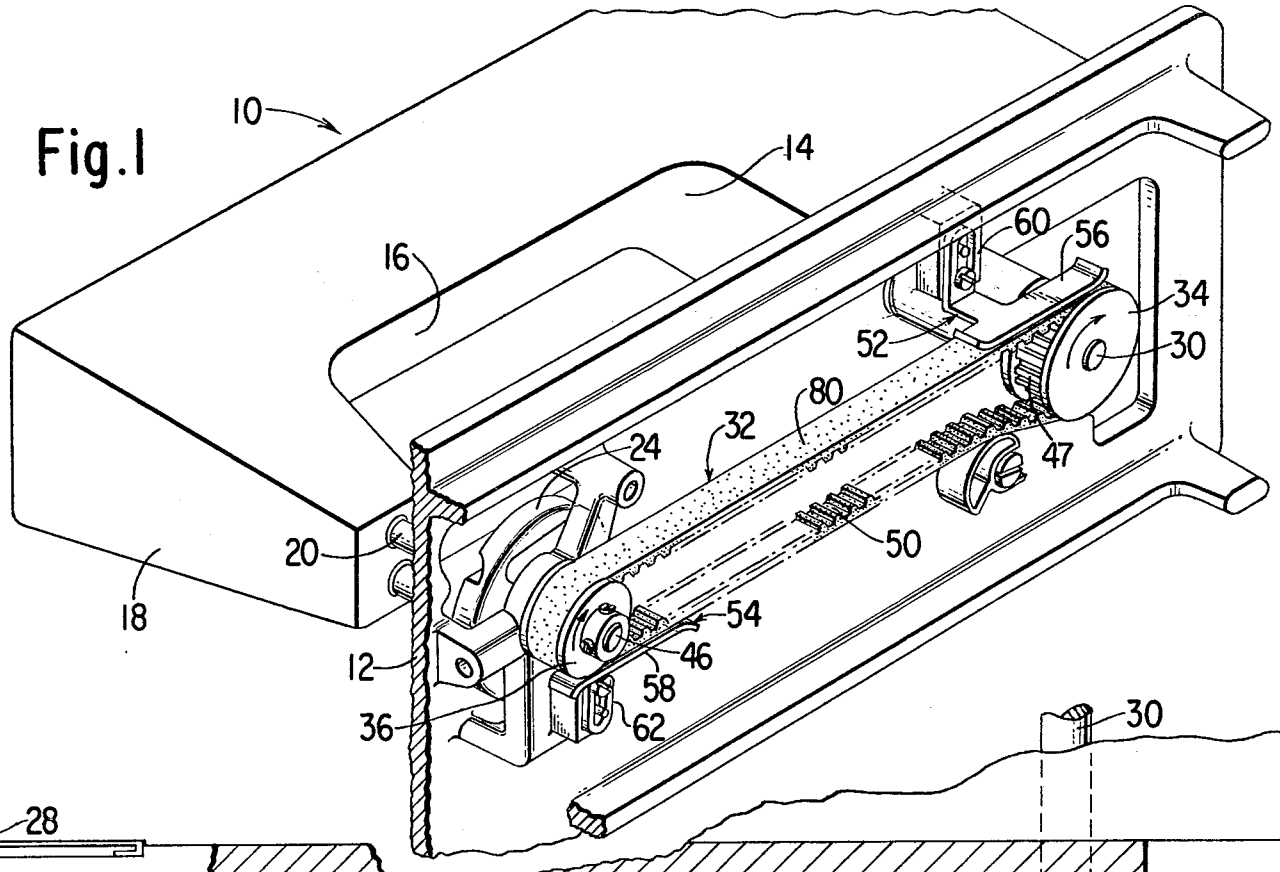
FIG. 1 is a bottom perspective view of a sewing machine showing a guarded belt drive according to the invention for a vertical axis loop taker.
Figure 2:
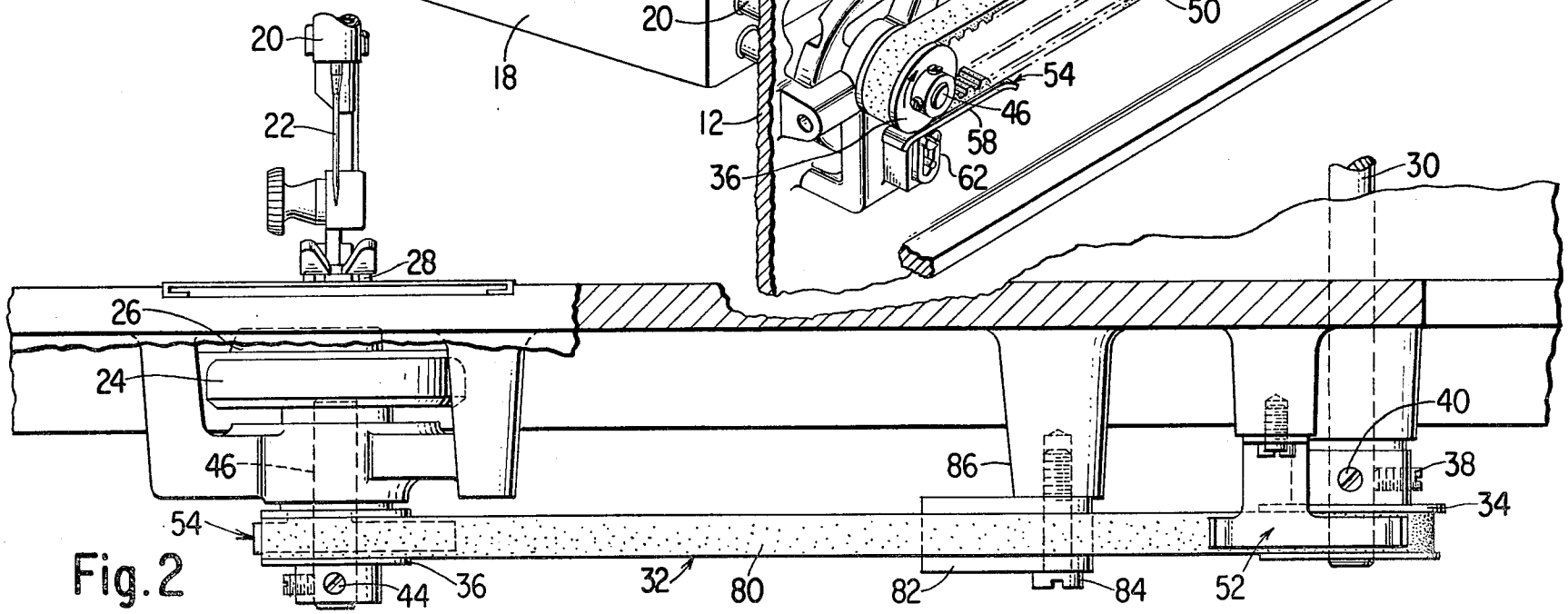
FIG. 2 is a fragmentary elevational view showing the bed and belt drive of the machine.

Referring to the drawings, reference character 10 designates a sewing machine including a bed 12, an upstanding standard 14, a bracket arm 16, and a head end portion 18 containing needle reciprocating mechanism including a needle bar 20 wherein a needle 22 is affixed. As is well known in the sewing machine art, an electric motor or the like may be provided for imparting drive power to the machine, such motor being generally connected through a shaft in the bracket arm with a crank mechanism for reciprocating the needle in an up and down relationship with respect to a work supporting surface on the bed to carry a thread through a fabric being sewn.

Supported within the bed 12 is a conventional vertical axis rotary loop taker 24 for seizing a loop of thread thrown out by the needle 22 during its penetration of the fabric and carrying the thread around a thread carrying bobbin (not shown) which is contained within a bobbin case 26 supported in the body of the loop taker, such that the needle thread is concatenated with the bobbin thread to form lockstitches in a well understood manner. As is also usual in sewing machines, a feed mechanism is provided for feeding the fabric under the sewing needle and including a feed dog 28 having a reciprocating motion for feeding the fabric across the work supporting surface of the bed so that continuous stitches can be made in the fabric. For purposes of convenience of illustration the drive mechanism for the feed dog 28 has been eliminated from the drawings but any suitable type of mechanism for driving the feed dog may be provided.

In order to drive the loop taker in timed relationship to the reciprocation of needle 22 a drive train is provided to operatively connect the loop taker to a shaft 30 which is driven by the motor of the machine along with the shaft in the bracket arm that transmits power to the needle actuating mechanism. Such drive train includes a flexible toothed timing belt 32, and toothed driving and driven pulleys 34 and 36, respectively, which are engaged by the belt. Pulley 34 is affixed by screws 38 and 40 to the motor driven shaft 30 and the other pulley 36 is affixed by screws 42 and 44 to a shaft 46 which is an integral part of the loop taker structure. As shown, teeth 47 on the pulley 34 and teeth 48 on the pulley 36 are engaged by the teeth 50 of the belt.

Motor driven shaft 30 acting through drive pulley 34, belt 32, driven pulley 36 and shaft 46 drives the loop taker in timed relationship to endwise reciprocation of the needle so long as the belt 32 is prevented from jumping teeth on the pulleys, and this is prevented in accordance with the invention with abbreviated belt guards 52 and 54 each of which is located on one side only of a belt engaged pulley.

The belt guards 52 and 54 include belt overlying flat elongate plate like portions 56 and 58 with upturned ends and with right angled arms 60 and 62 extending therefrom as shown. The guards 52 and 54 are secured to bosses 64 and 66 on the bed 12 with screws 68 and 70 which extend into the bosses through longitudinal slots 72 and 74 provided in the arms 60 and 62 to accommodate adjustment of the guards toward and away from the belt in a direction perpendicular thereto. Pins 76 and 78 affixed in the bosses 64 and 66 and extending through the arm slots prevent the guards from pivoting on the screws.

Figure 3:
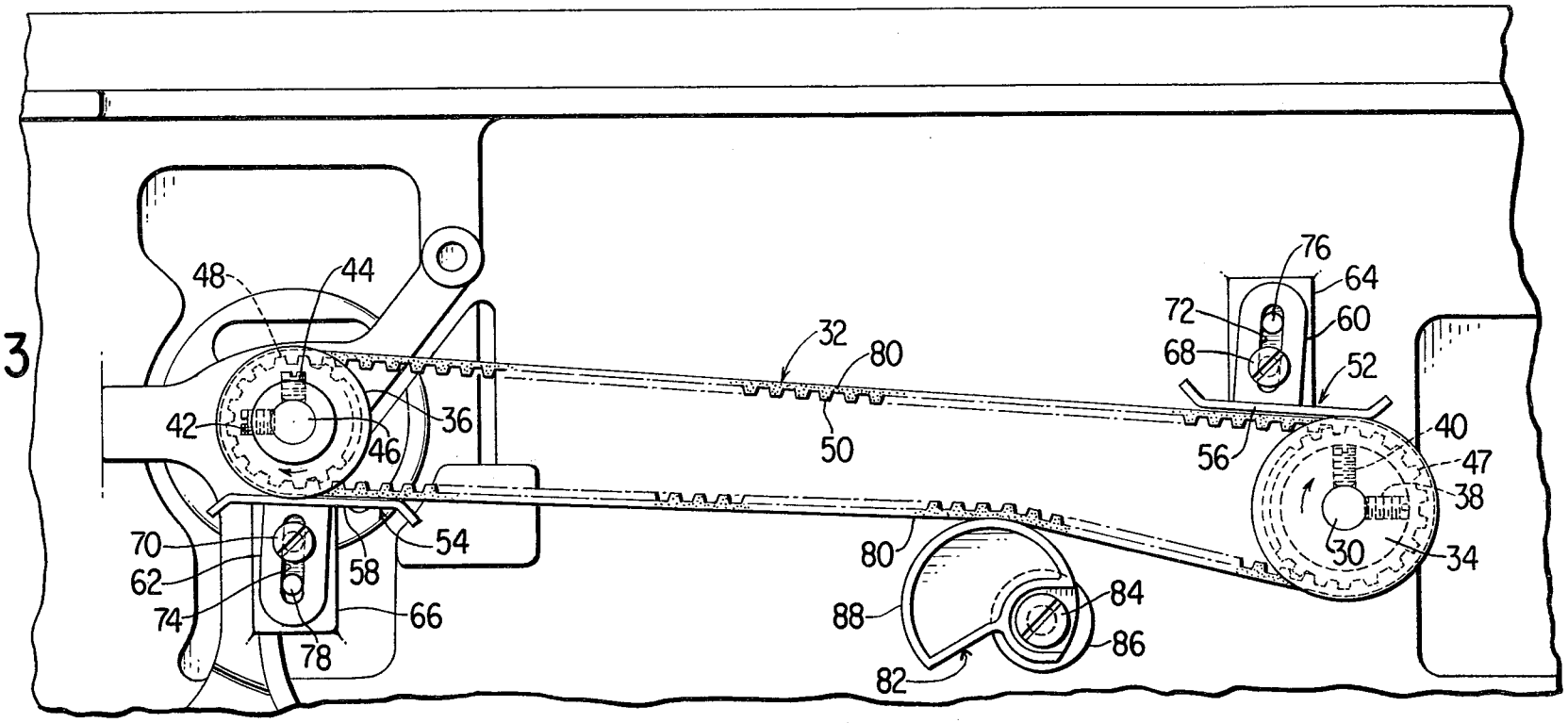
FIG. 3 is a fragmentary bottom view of the bed showing the belt drive.
Figure 4:
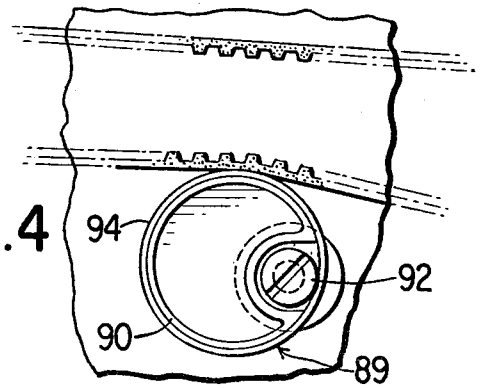
FIG. 4 is a fragmentary bottom view a belt tension adjuster.

The belt guards are located to extend over the belt where it moves into the pulleys as defined by their direction of rotation (clockwise as shown in FIGS. 1 and 3). At such locations, plate like portion 56 of guard 52 overlies the belt 32 on the belt entering side of pulley 34, and plate like portion 58 of guard 54 overlies the belt entering side of pulley 36. The guards should be adjusted to locate their belt overlying plate like portions 56 and 58 in close proximity to but nevertheless out of contact with the outer surface 80 of the belt before being secured in fixed position with screws 68 and 70. Reference character 82 designates a semicylindrical member which is eccentrically mounted with a screw 84 on a post 86 that is an integral part of the structure of the bed 12. The outer surface 88 of member 82 contacts the outer surface of the belt to deflect the belt inwardly, and by adjusting the member 82 about its eccentric axis before affixing it in place with screw 84 any desired degree of tension can be introduced into the belt. A modified form of tension adjuster as shown in FIG. 4, includes an eccentrically mounted cylinder 90 which is adjustable about a screw 92, and a rotatable ring 94 thereon that contacts the belt. The ring rotates to lessen friction and wear on the belt and adjuster.

During rotation of pulley 34 by shaft 30 and the transmission of power through the belt 32 to pulley 36 resulting in rotation of the pulley 36, shaft 46 and the loop taker 24, the guards 52 and 54 serve to guide the teeth on the belt into mesh with the teeth on the pulleys 34 and 36 respectively. The guards also prevent any significant outward movement of the belt away from the pulleys where overlapped by the guards, and so prevent teeth on the belt from jumping over teeth on the guard. Member 82 (or cylinder 90) is adjusted to render the belt taut and the belt teeth 50 are thereby prevented from separating prematurely from pulley teeth 47 as the belt exits from pulley 34. By reason of the described arrangement the transmission of power between the drive pulley 34 and driven pulley takes place smoothly without slippage and without a disturbance of the timing relationship between the loop taker and needle.

It is to be understood that the present disclosure relates to a preferred embodiment of the invention which is for purposes of illustration only and is not to be construed as limiting the invention. Numerous alterations and modifications will suggest themselves to those skilled in the art, and all such modifications which do not depart from the spirit and scope of the invention are intended to be included within the scope of the appended claims.

We claim:

1. In a sewing machine, a toothed driving pulley, a toothed driven pulley, a toothed timing belt extending over and in toothed engagement with both said pulleys for imparting rotation to the driven pulley when the driving pulley is rotated, a belt guard for each pulley, each belt guard being located for a predetermined direction of rotation of the driving pulley on the belt entering side only of the pulley with which the belt is associated and being disposed closely adjacent to the outside surface of the belt where the belt enters the pulley to thereby guide the belt onto the pulley and prevent teeth on the belt from jumping over teeth on the pulley, and inwardly acting belt deflecting means in engagement with a length of the timing belt extending between the unguarded belt exiting side of one pulley and guarded thread entering side of the other pulley, said length of timing belt being engaged by the belt deflecting means at a location therealong which is closer to the unguarded belt exiting side of the said one pulley then to the guarded thread entering side of the said other pulley.

2. The combination of claim 1 wherein the belt deflecting means is an eccentrically mounted semi cylindrical member.

3. The combination of claim 1 wherein the belt deflecting means is an eccentrically mounted cylinder having a rotatable member thereon which engages the said length of timing belt.

* * * * *

UNITED STATES PATENT OFFICE

CERTIFICATE OF CORRECTION

Patent No. 4,422,396 Dated December 27, 1983

Inventor(s) Jan Szostak and Henry Schaeflern

It is certified that error appears in the above-identified patent and that said Letters Patent are hereby corrected as shown below:

Title Page, [75] Inventor:, after "Jan Szostak, Lincroft, N.J.", insert -- ; Henry Schaeflern, Pittstown, N.J. --

Signed and Sealed this

*Twenty-fourth* Day of *July 1984*

[SEAL]

*Attest:*

GERALD J. MOSSINGHOFF

*Attesting Officer*

*Commissioner of Patents and Trademarks*